US007281475B2

(12) United States Patent
Kot

(10) Patent No.: US 7,281,475 B2
(45) **Date of Patent: *Oct. 16, 2007**

(54) METHOD OF CONTROLLING REGISTER WHEN OVERPRINTING A PLURALITY OF SEPARATED COLORS

(75) Inventor: Ulrich Kot, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/435,256

(22) Filed: May 16, 2006

(65) Prior Publication Data

US 2006/0201368 A1 Sep. 14, 2006

Related U.S. Application Data

(62) Division of application No. 09/563,391, filed on May 1, 2000, now Pat. No. 7,131,379.

(30) Foreign Application Priority Data

Apr. 30, 1999 (DE) ..... 199 19 741

(51) Int. Cl.
*B41L 3/02* (2006.01)

(52) U.S. Cl. ..... 101/486; 101/181; 101/248

(58) Field of Classification Search ..... 101/181, 101/216, 248, 485, 486
See application file for complete search history.

(56) References Cited

U.S. PATENT DOCUMENTS

| | | | |
|---|---|---|---|
| 4,690,051 | A | 9/1987 | Kishine et al. |
| 5,056,430 | A | 10/1991 | Bayerlein et al. |
| 5,138,667 | A | 8/1992 | Roch et al. |
| 5,327,826 | A | 7/1994 | Rodi |
| 5,412,577 | A | 5/1995 | Sainio et al. |
| 5,813,337 | A | 9/1998 | Peters et al. |
| 6,065,400 | A | 5/2000 | Van Weverberg |
| 6,085,658 | A | 7/2000 | Goldstein |
| 6,199,480 | B1 | 3/2001 | Leonhardt et al. |

FOREIGN PATENT DOCUMENTS

| | | |
|---|---|---|
| DE | 19721955 A1 | 12/1997 |
| JP | 06-8394 | 1/1994 |

*Primary Examiner*—Ren Yan
(74) *Attorney, Agent, or Firm*—Laurence A. Greenberg; Werner H. Stemer; Ralph E. Locher

(57) ABSTRACT

A method of controlling register when overprinting a plurality of separated colors, includes adjusting with register adjusting devices the position of image fields produced with the separated colors on a print carrier, so that the image fields are in register with one another. The position of all of the image fields on the print carrier are continuously changed simultaneously in the same direction by an equal amount.

12 Claims, 2 Drawing Sheets

METHOD OF CONTROLLING REGISTER WHEN OVERPRINTING A PLURALITY OF SEPARATED COLORS

CROSS-REFERENCE TO RELATED APPLICATIONS

This is a divisional application of application Ser. No. 09/563,391, filed May 1, 2000 now U.S. Pat. No. 7,131,379; the application also claims the priority, under 35 U.S.C. §119, of German patent application DE 199 19 741.5, filed Apr. 30, 1999; the prior applications are herewith incorporated by reference in their entirety.

BACKGROUND OF THE INVENTION

Field of the Invention

The invention relates to a method of controlling register when overprinting a plurality of separated colors, which includes adjusting with register adjusting devices the position of image fields produced with the separated colors on a print carrier, so that the image fields are in register with one another.

When several separated colors are being overprinted, the relative position of the image fields to one another has to be adjusted in order to obtain an in-register print. In rotary printing machines, register adjustment devices are provided, with which, respectively, the position of one of the image fields can be changed in the printing direction and transversely to the printing direction by displacement and rotation. It is known to define a contrast-rich color as a reference color and to adjust relative to the reference color the position of all the further image fields of the printing inks, which are used. In order to monitor the state of the image fields, use is made of register crosses or crosshair marks, which are viewed visually using a register cross reader, or register marks having reflection values which are detected by a photoelectric sensor. The position of the image fields in relation to one another can be maintained automatically by register control devices. One further possibility is to determine or define a reference position, irrespective of any of the separated colors, all of the image fields being adjustable relative to the reference position. In this case, none of the separated colors counts as the reference color.

Furthermore, it has been known to change the position only of areas in a image field, in order to compensate for faults caused by rotary printing, printing too narrow and printing too wide. Suitable actuating devices effect a deformation of the printing plate producing an image field.

During a set-up or make-ready phase, the magnitudes of the adjustments of the register adjusting devices are relatively large. In order to produce as few misprints as possible, the control and regulating devices for the register adjustment are optimized for speed. In accordance with the time response of the control and actuating elements, the position of a separated color is moved relative to the nominal or desired position thereof, a given overshooting of the nominal or desired position being possible, with the possibility disappearing after a given time.

If the position of the printed image relative to the edges of the print carrier is to be altered, all of the separated colors are displaced and rotated, respectively, to the same extent and in the same direction. A reference color can thereby serve as the leading color, the change in position thereof being followed by the other separated colors, with a given time delay, due to the action of a control device.

In web-fed offset printing machines, in particular, the paper web wraps partly around a blanket cylinder. The reason therefor is the cohesion between the printing ink applied to the paper web, and the printing ink remaining on the rubber blanket. If the rubber blanket is fastened in a cylinder gap formed in the blanket cylinder, the wrapping action of the paper web is abruptly terminated at the edge of the cylinder gap passing by. Reference is often made to a so-called cylinder-gap or channel impact, which causes paper particles to be detached from the web and deposited on the rubber blanket. The deposition of the paper particles takes place at first in non-printing areas of the surface of the rubber blanket and, as contamination increases, progresses into the printing areas. A consequence thereof is that a reduction in the size of the printing dots occurs, leading to a change in coloration in the printed image. This can be countered, to a limited extent, by increasing the ink feed. Disadvantageous, in this regard, is that, after a blanket washing operation, instabilities in the coloration occur, because too much ink is present briefly in the printing unit. Systems, which automatically reduce the ink feed following a cleaning operation are imperfect, because the ink reductions are difficult to calculate, due to a great number of influencing factors. The problems associated with the cylinder-gap or channel impact occur, in particular, in web-fed printing machines which are constructed for printing on both sides of a web.

SUMMARY OF THE INVENTION

It is accordingly an object of the invention to provide a method of controlling register when overprinting a plurality of separated colors by which the number of cleaning operations is reduced, and by which the print quality is improved.

With the foregoing and other objects in view, there is provided, in accordance with the invention, a method of controlling register when overprinting a plurality of separated colors, which includes adjusting with register adjusting devices the position of image fields produced with the separated colors on a print carrier, so that the image fields are in register with one another, which comprises continuously changing the position of all the image fields on the print carrier simultaneously in the same direction by an equal amount.

In accordance with another mode of the method invention, the changes are periodic, and the duration of a period is significantly longer than the duration of a printing cycle.

In accordance with a concomitant mode of the method invention, during cyclic printing on a printing machine, the changes are at a frequency that is dissimilar to the inherent or characteristic frequency, and the harmonics thereof, of the printing machine.

Due to the continuous change in the position of the image fields, a cleaning effect for the print transfer material, in particular for rubber blankets of offset printing machines, is produced. The effect of changing the position is that other areas of the print transfer material continually come into use during the ink transfer. Contaminants are detached from the print transfer material during the ink transfer, and are transferred to the print carrier with the printing ink. Using register adjusting elements, the position of all the separated colors is changed in the printing direction and transversely thereto, for example by amounts between 0.01 and 0.03 mm, in a cycle of about 2 to 6 minutes. The magnitudes of the adjustment are considerably greater than the screen count or resolution of the image dots. If the change to the position of the image fields takes place slowly, then in the case of rotary printing machines having color register regulation, it is possible to adjust circumferential and lateral register of a primary color in a predefined flow chart, the other separated colors following the change to the position of the primary color relatively quickly, so that no register deviations occur which are visible to the human eye. The range of the position changes lies within the range of the permissible tolerances for the position of the printed image in relation to the edges of the print carrier or stock.

In the case of cyclic changes in the position of the image fields, the duration of the cycle can be coordinated with the period of inherent or characteristic mechanical oscillations in the printing machine. The amplitude, the stroke and the waveform of the cyclic position changes can be coordinated with the screen count or width and the screen angle of the image fields. Likewise, it is possible to optimize the movement sequences of the image fields with regard to the mechanical construction of an elastic cylinder cover. The movement sequences can be based upon the spacing and the direction of textile fibers of the cover and/or on the grid size of a structured covering surface. The speed profile of the movement sequences can differ considerably in the direction of printing and transversely thereto. For example, the position changes of an image field can be performed more rapidly in the printing direction than transversely to the printing direction.

Other features which are considered as characteristic for the invention are set forth in the appended claims. Although the invention is illustrated and described herein as embodied in a method of controlling register when overprinting a plurality of separated colors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
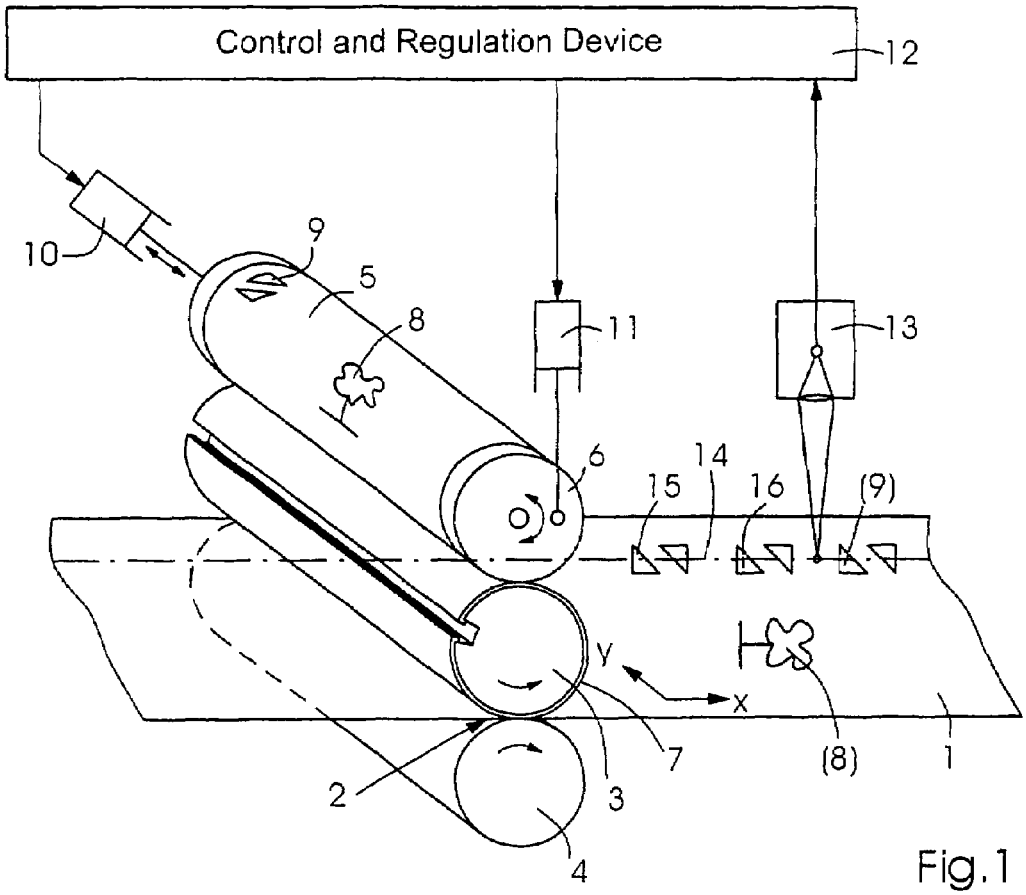
FIG. 1 is a diagrammatic and schematic view of a device for adjusting register in accordance with the method of the invention.

Referring now to the drawings and, first, particularly to FIG. 1 thereof, there is shown therein, very diagrammatically, the last printing unit of a printing machine for printing onto a web 1. As the web 1 is conveyed in the printing nip 2 between a transfer cylinder 3 and an impression cylinder 4, printing ink is applied to the web 1 in accordance with an image field. The image field has been produced as a color separation on a printing plate 5 that is disposed on a plate cylinder 6, which is in rolling contact with a rubber blanket 7 of the transfer cylinder 3.

The image field includes both an actual useful printed image 8 and register marks 9. The position of the image field on the web 1 is adjusted in the printing direction x and in the lateral direction y so that the image field is positioned exactly in relation to the previously printed image fields. At the outlet from the printing machine, i.e., at the delivery thereof, the web 1 has good quality printed images formed thereon, maintenance of the register of which requires no further corrections. In order to adjust the register, register adjusting devices 10 and 11 are provided on each printing unit. When the register adjusting device 10 is actuated, the plate cylinder 6 and the printing plate 5 are displaced in the lateral direction y. The result is a like or equal displacement of the image field on the web 1 in the lateral direction y. When the register adjusting device 11 is actuated, the phase angle of the plate cylinder 6 and of the printing plate 5 is adjusted in relation to the phase angle of the transfer cylinder 3. The result is a displacement of the image field in the printing direction x. The register adjusting devices 10 and 11 are connected to a control and regulating device 12. The web 1 is scanned by a photoelectric detector 13 along a line 14, which runs in the printing direction x and in which the register marks 9, 15 and 16 of all the separated colors are printed. The positions of all the image fields on the web 1 can be registered by using the detector 13. The detector 13 supplies the actual value signals for the register deviations $r_u$, $r_s$ in the circumferential and lateral direction to the control and regulating device 12.

Figure 2:
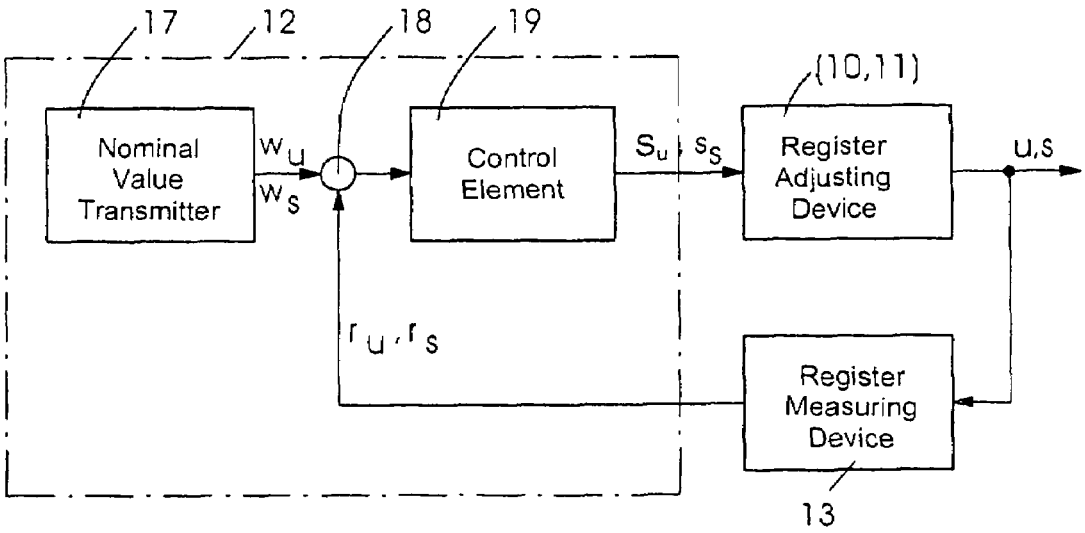
FIG. 2 is a schematic block diagram of an arrangement for controlling and regulating register, which is shown in greater detail than in FIG. 1.

As illustrated in greater detail in FIG. 2, the control and regulating device 12 includes a nominal or desired value transmitter 17, a comparator 18 and a control element 19 for each of the printing inks. In the comparator 18, the actual value signals $r_u$, $r_s$ are compared with desired or nominal value signals $w_u$, $w_s$ from the desired or nominal value transmitter 17. In the control element 19, the comparison signals are used to form actuating variables $s_s$, $s_u$ which are fed to the register adjusting devices 10, 11.

Figure 3:
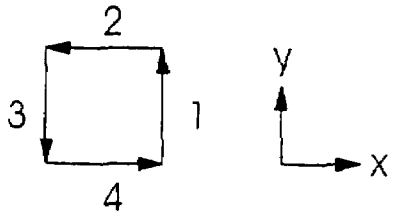
FIGS. 3 to 6 are schematic diagrams relating to changing the position of an image field.
Figure 4:
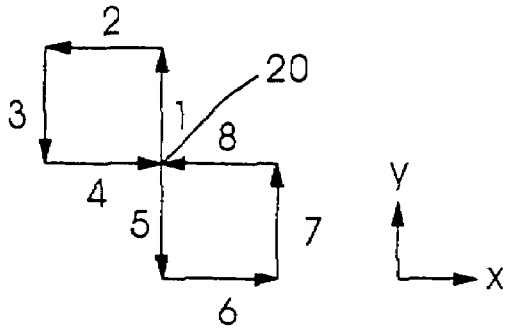
Figure 5:
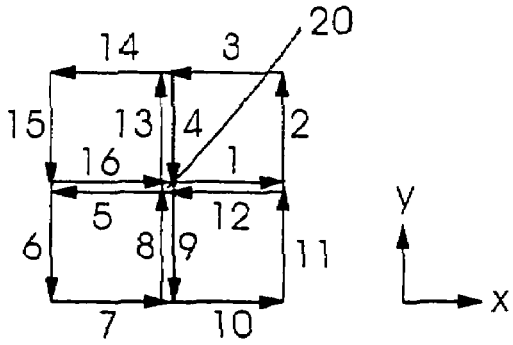
Figure 6:
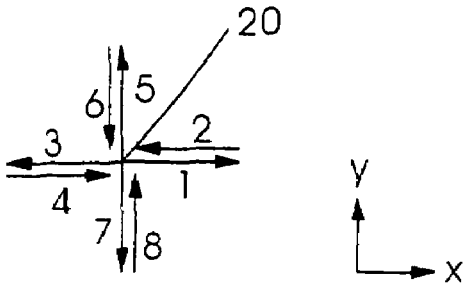

The desired or nominal value signals $w_u$, $w_s$ for a primary color are subject to continuous long-term changes, the actual value signals $r_u$, $r_s$ of the primary color and of the further image fields following these changes rapidly. The position of the image field of the primary color on the web 1 is therefore changed in accordance with the vector diagrams shown in FIGS. 3 to 6. The numbers plotted in FIGS. 3 to 6 describe the order of the displacements in the x-y direction. The displacements lie in the range from 0.01 to 0.03 mm, a cycle being completed in a period of 2 to 6 minutes. The displacement ensures that other areas of the rubber blanket 7 continuously become ink-carrying, as a result of which dirt deposited on the rubber blanket 7 is transported away via the ink and the material of the web 1. According to FIG. 3, the register of the primary color and of the further colors executes a rectangular movement. As FIG. 4 or FIG. 5 shows, there is a possibility of providing two or four rectangular movement cycles, which start from a common starting point 20. The variant shown in FIG. 6 is a reciprocating displacement, beginning from the starting point 20. The displacements in the printing direction x and in the lateral direction y can proceed at different speeds. The displacements can occur along curved paths. It is possible to configure the displacement sequences differently in different subjects to be printed. In the case of subjects, which tend to form Moire fringes, or in the case of printing machines having mechanical oscillations which lead to cyclic register deviations, the phase, frequency and amplitude of the displacement sequences can be dimensioned so as to correspond with these phenomena. A number of selective displacement sequences can be provided in the control and regulating device 12. In the case of printing machines, which permit oblique register displacement in addition to circumferential and lateral register adjustment, the displacements described hereinabove can be combined further with synchronous rotations.

I claim:

1. A method of controlling register when overprinting a plurality of color separations, the method which comprises the following steps:

adjusting with register adjusting devices a plurality of printing cylinders to adjust a position of image fields produced with the color separations on a printing carrier, causing the image fields to be in register with one another; and simultaneously changing a position of all of the printing cylinders to adjust the image fields to be produced on the printing carrier simultaneously in the same direction by an equal amount, causing the position of the image fields relative to one other on the print carrier to be unaffected by simultaneous change.

2. The method according to claim 1, wherein the changes are periodic, and a duration of a period is significantly longer than a duration of a printing cycle.

3. The method according to claim 2, wherein the duration of a period is in a range of from 2 to 6 minutes.

4. The method according to claim 1, wherein, during cyclic printing on a printing machine, a frequency of the changes is not identical with an inherent frequency and its harmonic vibrations of the printing machine being used.

5. The method according to claim 1, wherein a range of the positional changes lies within permissible tolerances for the position of the printed image on the print carrier.

6. The method according to claim 5, which further comprises executing a displacement of the positional changes in a range of from 0.01 to 0.03 mm.

7. The method according to claim 1, which further comprises executing the step of simultaneously changing a position of all of the printing cylinders to adjust the image fields in a rectangular movement.

8. The method according to claim 1, which further comprises executing the step of simultaneously changing a position of all of the printing cylinders to adjust the image fields in a plurality of rectangular movement cycles, starting from a common starting point.

9. The method according to claim 1, which further comprises executing the step of simultaneously changing a position of all of the printing cylinders to adjust the image fields in a reciprocating displacement.

10. The method according to claim 1, which further comprises executing the step of simultaneously changing a position of all of the printing cylinders to adjust the image fields along curved paths.

11. The method according to claim 1, which further comprises carrying out the step of simultaneously changing a position of all of the printing cylinders to adjust the image fields in a printing direction and in a lateral direction at different speeds.

12. The method according to claim 1, which further comprises executing the steps in a web-fed offset printing machine.

* * * * *